US005971481A

United States Patent [19]

Emmenegger et al.

[11] Patent Number: 5,971,481

[45] Date of Patent: Oct. 26, 1999

[54] CHAIR, SPECIALLY AN OFFICE CHAIR

[75] Inventors: Wolfgang Emmenegger, Dangstetten, Germany; Anton Erne, Full; Jörg Huber, Villingen, both of Switzerland

[73] Assignee: Giroflex Entwicklungs AG, Koblenz, Switzerland

[21] Appl. No.: 09/077,884

[22] PCT Filed: Oct. 7, 1997

[86] PCT No.: PCT/CH97/00378

§ 371 Date: Jul. 8, 1998

§ 102(e) Date: Jul. 8, 1998

[87] PCT Pub. No.: WO98/16138

PCT Pub. Date: Apr. 23, 1998

[30] Foreign Application Priority Data

Oct. 11, 1996 [CH] Switzerland ..... 2479/96
Sep. 23, 1997 [CH] Switzerland ..... 2237/97

[51] Int. Cl.[6] ..... A47C 1/032

[52] U.S. Cl. ..... 297/300.8; 297/300.4; 297/301.7

[58] Field of Search ..... 297/300.2, 300.3, 297/300.4, 300.5, 300.6, 300.7, 300.8, 301.6, 301.7, 302.6, 302.7

[56] References Cited

U.S. PATENT DOCUMENTS 4,384,741 5/1983 Flum et al. ..... 297/300.5
4,685,733 8/1987 Machate et al. ..... 297/300.6 X
4,773,706 9/1988 Hinrichs ..... 297/300.5
4,966,411 10/1990 Katagiri et al. ..... 297/300.3 X
5,658,045 8/1997 Van Koolwijk et al. ..... 297/300.5
5,685,607 11/1997 Hirschmann ..... 297/301.7

FOREIGN PATENT DOCUMENTS 0539733 5/1993 European Pat. Off. .
2642091 3/1978 Germany .
9315337 3/1994 Germany .
93/15631 8/1993 WIPO .

*Primary Examiner*—Peter R. Brown
*Attorney, Agent, or Firm*—Greenblum & Bernstein, P.L.C.

[57] ABSTRACT

An office chair that is adjustable in height and inclination includes a carrier body held on an upright standard, a swivel body arranged on a knee side of the carrier body, a seat carrier which is swivellable about a first joint position on the knee side. A backrest carrier is operatively connected to the seat carrier at a second joint position and is coupled with the carrier body by a third joint position. The carrier body additionally has an arcuate link guide, and a link block guide can swivelly hold the backrest carrier in the link guide, the link guide is arranged between the first joint position and the upright standard. The backrest carrier is guided along the link guide, and the seat carrier, which is operatively connected with the backrest carrier, can be selectively and releaseably arranged in a plurality of positions by a snap-in mechanism. The snap-in mechanism is provided on the carrier body and can be brought into engagement with the backrest carrier.

18 Claims, 10 Drawing Sheets

CHAIR, SPECIALLY AN OFFICE CHAIR

BACKGROUND OF THE INVENTION

1. Field of the Invention

The invention relates to a chair, in particular to an office chair which is adjustable in the height and the inclination, with a carrier body held on an upright standard, a first joint position which is arranged thereon on the knee side and is arranged in the form of a swivel axis oriented transversally to the sitting direction, a seat carrier which is swivellable about the first joint position against the restoring force of at least one spring element and a backrest carrier operatively connected with the same by way of a second joint position, which carrier is coupled by way of a third joint position with the same for the swivelling movement which is oriented relative to the carrier body in the sitting direction.

2. Discussion of the Background Information

From EP-A 0 539 733 an office chair of the aforementioned kind is known in which a seat carrier together with a backrest carrier is adjustable with respect to a carrier body in the shape of an extension arm, with the back rest carrier, which engages below the seat carrier with a horn-shaped lower partial element, being connected by band-shaped connecting elements, which roll up and down during the movements, with the seat carrier in such a way that during the rearward oriented movement the backrest carrier is lowered and the seat carrier is simultaneously moved forward by guidance in an additional knee-sided oblong hole and is lowered in the rear section, with the movement of the seat carrier being guided on a first runway which is provided on the part of the carrier body on the backrest side and arranged in the shape of a wave, and the backrest carrier being guided, independent therefrom, by means of a guide means, which is arranged on the inner side and is approximately arc-shaped, on two bearing journals which are arranged at a distance from one another on the carrier body. In order to achieve the transfer movements in this office chair, it is necessary that on the one hand the seat carrier is rolled by means of a roller, which is arranged in the zone on the backrest side, one the wave-shaped runway right up to the zone of the upright standard and on the other hand the backrest carrier with the horn-shaped partial element must be pushed substantially right up to the knee-sided zone.

From DE-A 2 642 091 a further office chair is known, which substantially comprises an upright standard, a bearing part for a seat plate as well as a backrest and in which the backrest is arranged on an approximately perpendicular first section of a backrest carrier which is guided with a second bow-shaped partial element, which is provided with rollers for example, in a recess of a bearing element, which recess is provided below the seat plate on the carrier element and is arranged in a bow shape in an analogous manner, with the sliding movement occurring during the backrest inclination being swivellable about an imaginary axis disposed above the seat plate and corresponding substantially to the hip joint of the user.

SUMMARY OF THE INVENTION

The invention is based on the object of providing a compact and simple constructional and economical arrangement of the functional elements for an office chair pursuant to the type of product as mentioned in the preamble of claim 1, by means of which relatively small relative movements of the individual functional elements with respect to one another lead to the achievement of an ergonomic sequence of movements of the backrest carrier which is operatively connected with the seat carrier.

In accordance with the invention this object is achieved in such a way that the backrest carrier is swivellably held relative to the carrier body by way of at least one link guide means in form of an approximately arc-shaped curved path, which means is arranged between the knee-sided joint position and the upright standard and is oriented in the direction of the swivelling movement, with the swivelling movement oriented backwards in the sitting direction and then oriented forwards being fixable in and then again detachable from several, randomly selectable positions by means of a snap-in locking mechanism which is arranged on the carrier body and can be brought into engagement with the backrest carrier.

Further features arise from the description below in conjunction with the claims and the drawing.

BRIEF DESCRIPTION OF THE DRAWINGS

Embodiments of the invention are explained below in closer detail by reference to the enclosed drawings, wherein.

DETAILED DESCRIPTION OF THE PRESENT INVENTION

Figure 1:
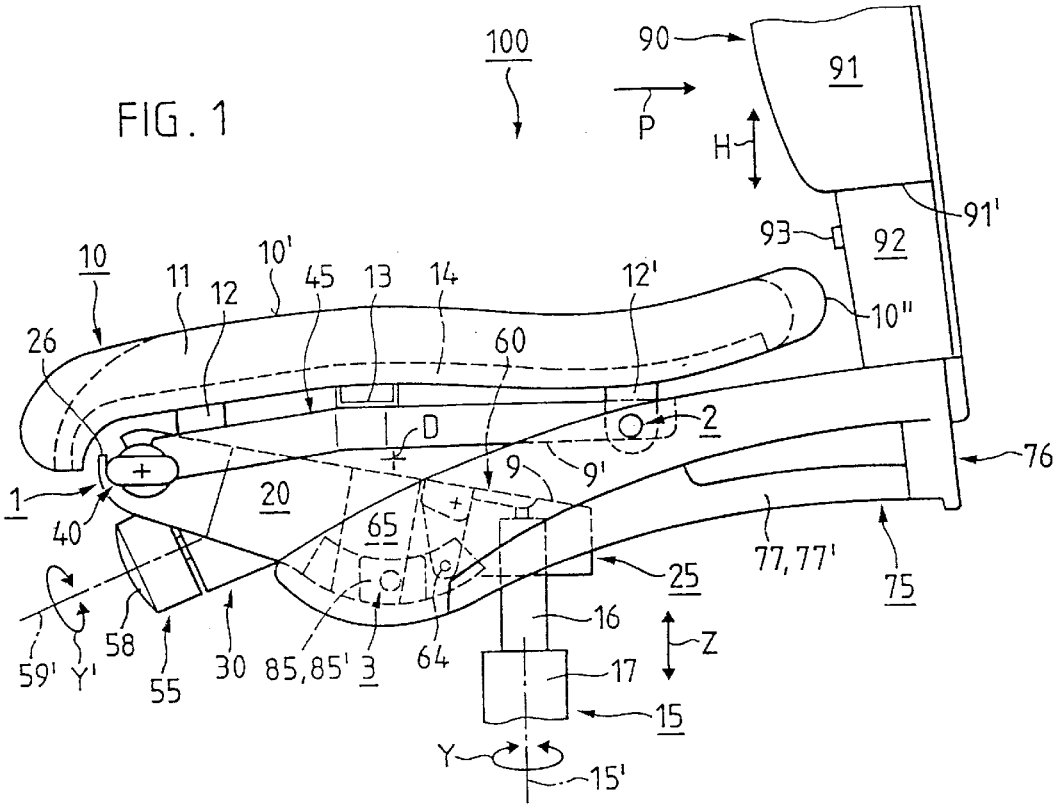
FIG. 1 shows an office chair in the sitting and working position in a schematic side view and as a first embodiment.

The drawing show a chair, in particular an office chair which is adjustable with respect to its height and inclination, which shall be described below in greater detail in connection with the functional units for achieving the adjusting movements as well as the locking of the movements as well as for explaining the cooperation of the individual functional units in detail.

Figure 2:
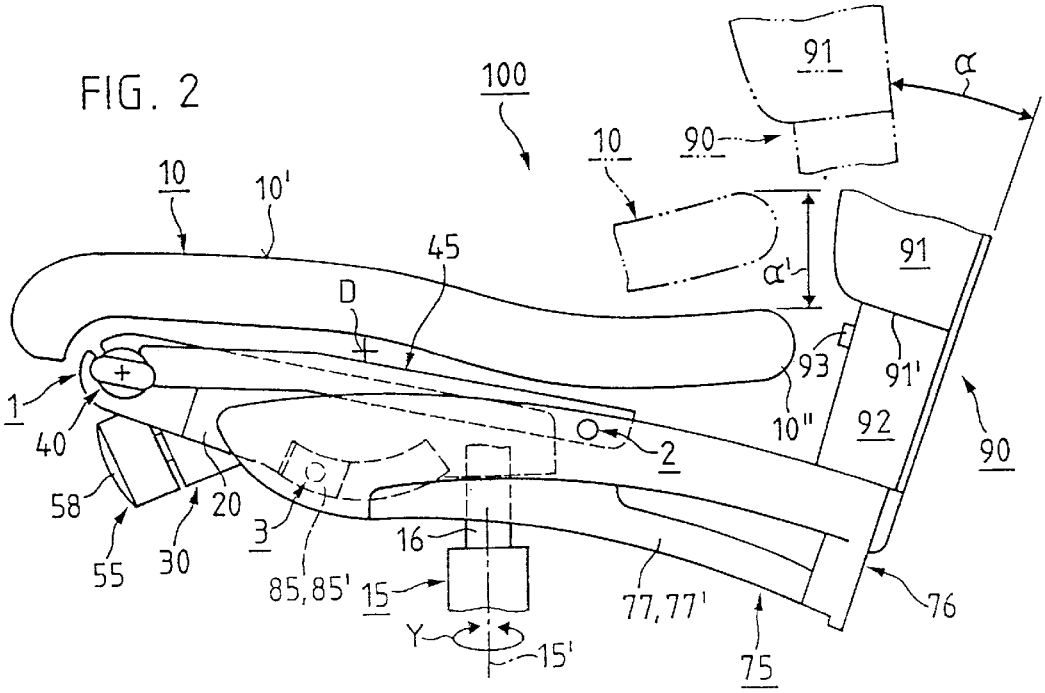
FIG. 2 shows the office chair pursuant to FIG. 1 represented in a reclined resting position and swivelled about a horizontal swivel axis.
Figure 3:
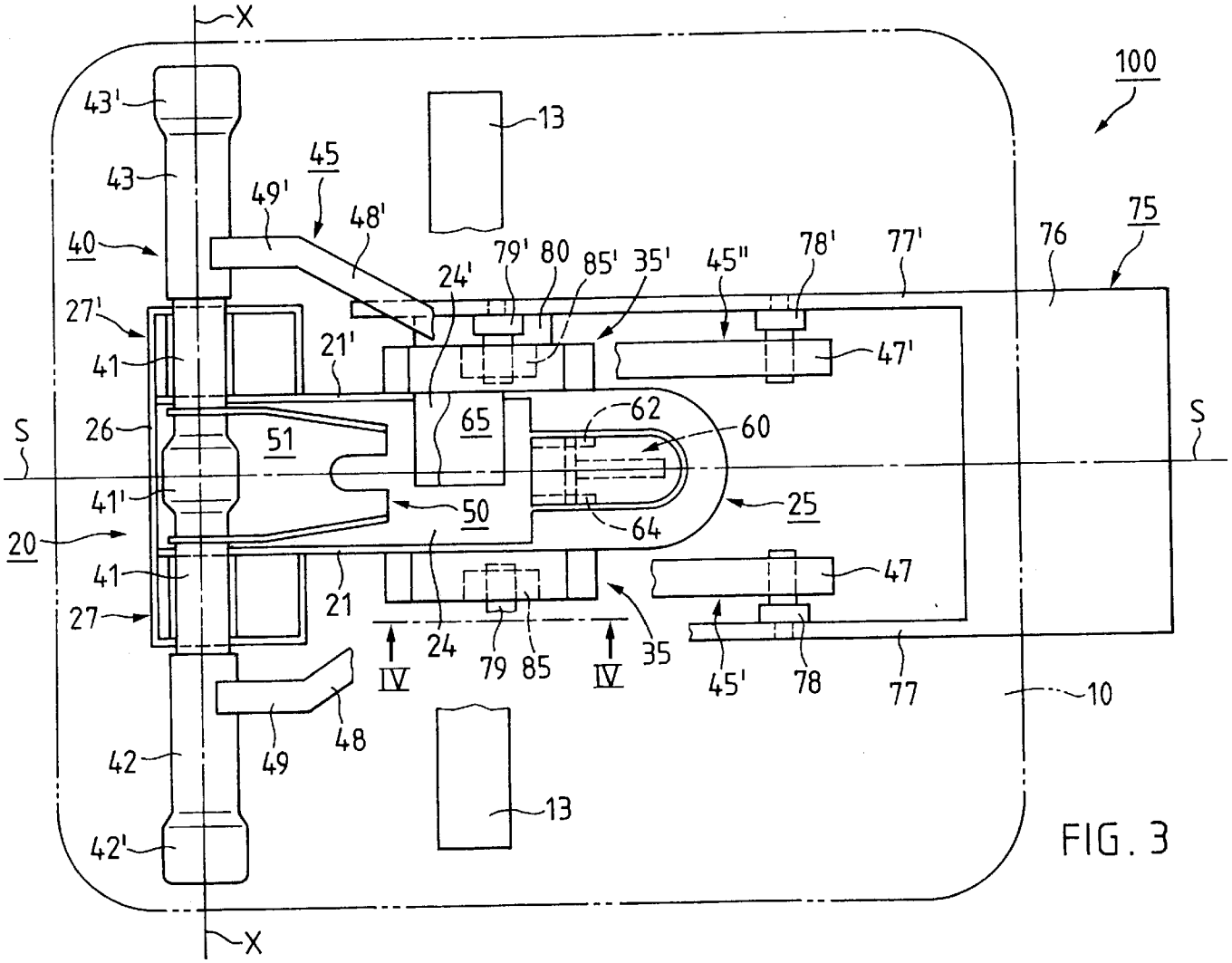
FIG. 3 shows the office chair pursuant to FIG. 1 with the most important functional elements in a schematic top view and on an enlarged scale.

FIGS. 1 to 3 show as a first embodiment the of ice chair in accordance with the invention which is designated in its entirety with reference numeral 100 and is shown in FIG. 1 in a schematic side view and in the working position, in FIG. 2 in a schematic side view and in the backwardly inclined (i.e., upright position) (i.e., reclined position) against the effect of at least one torsional element arranged on the knee side (i.e., the side proximate to the knees of one sitting in the chair) in a horizontal swivel body 40 and in FIG. 3 in a schematic top view. FIGS. 4 to 10 show the individual functional units for achieving the adjusting movement and the locking of the aforementioned movements.

Figure 9:
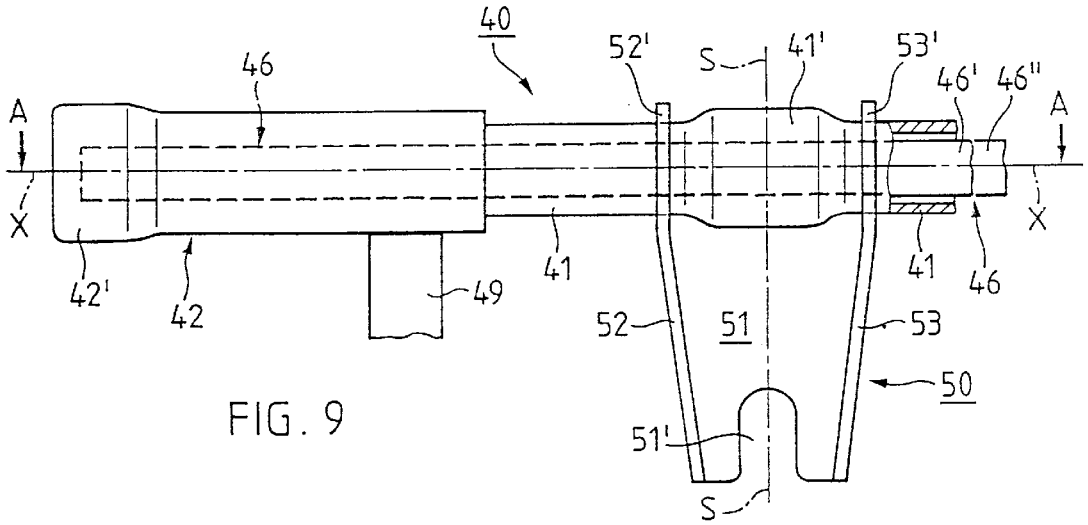
FIG. 9 shows a section of the knee-sided horizontal swivel axis for the office chair pursuant to FIG. 1 represented in a top view and on an enlarged scale.

Office chair 100 comprises, as is represented in FIG. 9, substantially a seat 10, an upright standard 15, a carrier body 20 held thereon and and the swivel body 40 which is held in the knee-sided zone on the carrier body 20 and is provided with the torsional element which is not shown here. A seat carrier 45 and a backrest carrier 75 which is connected to the seat carrier and is held on the carrier body 20 are arranged on the swivel body 40. The backrest carrier 75 is used for receiving a schematically shown backrest which is designated in its entirety with reference numeral 90, having a cushion element 91 arranged on a carrier arm 92. A pushbutton 93 operatively connected with an adjustment mechanism (not shown) is arranged between the backrest-sided surface 10" of the seat 10 and the lower edge 91' of the cushion element 91. By pressing the pushbutton 93 it is possible to adjust the height of the cushion element 91 relative. to the seat 10 in th e direction of the double arrow H.

The arrangement of the pushbutton 93 on the lower side of the carrier arm 92 between the seat 10 and the lower edge 91' of the cushion element 91 leads to the advantage that the pushbutton 93 can be easily actuated with one hand from the left or the right by the user seated on the office chair 100 and with the other hand the cushion element 91 can be height-adjusted as required. The special arrangement of the snap-in locking mechanism preferably integrated in the carrier arm 92 is not the subject matter of this invention and shall therefore not be represented or described in greater detail.

The seat carrier 45 which is operatively connected with the swivel body 40 is held on the carrier body 20 on the knee-side by means of the swivel body 40 which is designated as the first joint position 1. In the zone on the backrest side the seat carrier 45 is held on the backrest carrier 75 by way of a second joint position 2 which is arranged close to the upright standard 15 and on the backrest side with respect thereto. The backrest carrier 75 comprises two carrier arms 77 and 77' which are oriented in the direction of the knee-sided swivel body 40 and are each held by way of a third joint position 3 on the carrier body 20, which joint position is arranged between the upright standard 15 and the knee-sided swivel body 40. The aforementioned, generally mentioned elements, namely the seat 10, the upright standard 15, the carrier body 20, the swivel body 40, the seat carrier 45 and the backrest carrier 75 as well as the functional elements which are operatively connected with the same and the special arrangement of the joint positions 1,2 and 3 will be explained below in detail.

As is shown in FIG. 3, the knee-sided joint position 1 forms in combination with the swivel body 40 a horizontal swivel axis X—X extending substantially over the entire width of the seat 10.

The seat which is designated in its entirety with the reference numeral 10 comprises a seat plate 14 as well as a cushion 11 which is attached thereon in a manner not shown in greater detail. Seat 10 is arranged on the seat carrier 45 by means of pillow blocks 12 and 12' which are arranged respectively at a distance from one another. The special shape and arrangement of the seat plate 14 which is provided with the cushion 11 is not the subject matter of this invention and shall therefore not be described in greater detail.

The upright standard 15, which is shown in FIG. 1 only partly, comprises an upright stand pipe 17 in which a gas compression spring 16 is arranged which is shown schematically and is operatively connected with an actuating mechanism 60. The elements of the office chair 100 which are held on the upright standard 15 can be rotated in the direction of the double arrow Y about a vertical axis 15' and can be height-adjusted by means of the gas compression spring 16 in the direction of the double arrow Z and can be fixed at any desirable height with respect to the floor. The actuating mechanism 60 which is operatively connected with the gas compression spring 16 and is mentioned above will be explained below in connection with FIG. 4.

Figure 8:
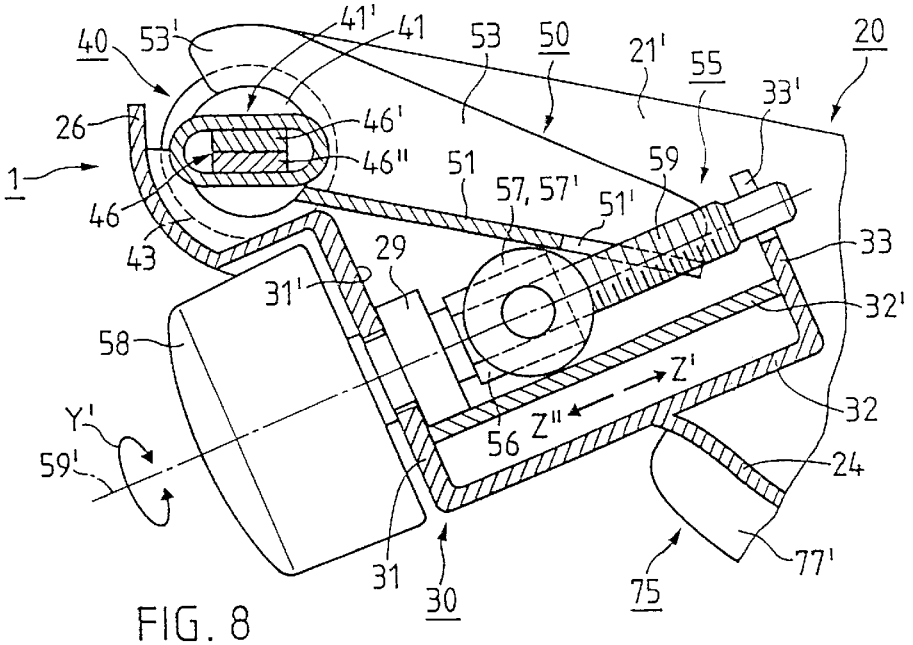
FIG. 8 shows a fastening mechanism for the horizontal swivel axis of the office chair pursuant to FIG. 1 represented as an embodiment.

The carrier body 20 which is represented in FIGS. 1 and 2 in a schematic view and in FIG. 3 in a top view comprises a head element 25 which is arranged for bearing the upright standard 15 and is provided with a bearing casing 23 (FIG. 4), two side walls 21 and 21' which are arranged at a parallel distance from one another with respect to an axis of symmetry S—S and which are connected by a base 24 oriented in the direction of the direction of the knee-sided swivel body 40 starting from the head element 25. The base 24 is provided in the zone of the third joint position 3 with a recess 24' (FIG. 3) which penetrates the base 24. A snap-in locking mechanism 65 is arranged in the recess 24', which mechanism is fastened by means which are not represented, e.g. by a screwed connection or the like on the one side wall 21' of the carrier body 20. In the forward knee-sided zone of the carrier body 20 an attached supporting bearing 30 is provided which ends in an upwardly bent face wall 26. The supporting bearing 30 is used for receiving and bearing a tensioning mechanism 55 which is operatively connected with an adjusting wheel 58. The tensioning mechanism 55, which will be explained below in greater detail in connection with FIG. 8, is actuated by the adjusting wheel 58 (FIG. 1) which is rotatable about the axis 59' in the direction of the arrow Y'.

The special arrangement and design of the individual joint positions 1,2 and 3 in the individual elements ensures that in a swivelling movement oriented in the direction of arrow P (FIG. 1) the backrest 90 is moved by an angle $\alpha$ and the backrest carrier 75 and the seat carrier 45 operatively connected therewith and seat 10 are moved from the resting or working position (FIG. 1) with an angle α' to the inclined or lowered or relax position (FIG. 2). As a result of the special arrangement and design of the individual functional elements it is achieved that the angle α' is approx. half as large as the angle α.

In a preferred arrangement and design of the individual functional elements which are operatively connected the backrest is swivelled with an angle α of approx. 24° and the seat carrier 45 with the seat 10 is lowered with an angle α' of approx. 12°. Experiments have shown that in this rearwardly inclined position the respective user still assumes and feels a pleasant and subjectively secure sitting position.

FIG. 3 shows the office chair 100 on an enlarged scale and in a schematic top view. One can recognize the carrier body 20 which is arranged on the axis of symmetry S—S, held with the head element 25 in a manner not shown in greater detail on the upright standard and comprising in the knee-sided zone two bearings 27,27' which are shown schematically and are arranged at a distance from one another on the side walls 21, 21'. The bearings 27,27' are arranged for receiving the swivel body 40 which is arranged transversally to the axis of symmetry S—S and substantially forms the swivel axis X—X. Moreover, FIG. 3 also shows two link guide means 35 and 35' which are designed for bearing the backrest carrier 75, are arranged at a distance to the swivel axis X—X and are disposed in the shown embodiment on the side walls 21 and 21' of the extension-arm-like carrier body 20. The link guide means 35 will be explained below in closer detail in connection with FIG. 4.

The link guide means 35,35' which are arranged with respect to the axis of symmetry S—S on both sides of the carrier body 20 can be arranged in form of a separate component and can be attached in a manner not shown on the side walls 21,21' of the carrier body 20. In an embodiment not shown in greater detail the link guide means 35,35' can also be arranged as a recess (not shown in greater detail) which is worked into the respective side walls 21 and 21' or as hollows or the like which are limited by the side walls 21 and 21'.

As is further shown in FIG. 3, the seat carrier 45 is arranged on the knee-sided swivel body 40 and fastened with means not shown. The seat carrier 45 comprises, for example, two longitudinal carriers 45' and 45" which are formed from sections 49,49' and 48,48' and in which the two sections 49,49' which are attached on the swivel body 40 are connected by the sections 48,48' which are oriented obliquely in the direction of the axis of symmetry S—S with the sections 47,47' which are arranged at a parallel distance to the axis of symmetry S—S. The backrest carrier 75 comprises two carrier arms 77 and 77' which are arranged at a parallel distance to the axis of symmetry S—S and which are mutually connected in the backrestsided zone by a first transition element (i.e., first connecting element) 76 and approximately in the zone of the third joint position 3 by a second transition element (i.e., second connecting element) 80. The second transition element 80 which is arranged as a snap-in element approximately arc-shaped according to the swivelling movement can be brought into engagement with the snap-in locking mechanism 65 for different sitting positions, which mechanism is arranged on the carrier body 20. A first embodiment of the snap-in locking mechanism 65 will be described below in connection with FIGS. 5 to 7.

Two bearing elements which are arranged at a distance from one another as hinge bolts 78,78' and 79,79' are arranged on the two carrier arms 77 and 77' of the backrest carrier 75 and are attached in a manner not explained in closer detail. The first hinge bolts 79,79' which form the third joint position 3 and are arranged correspondingly with respect to one another are held in the respectively assigned link guide means 35,35' with the respective sliding block 85 and 85' arranged thereon. The two second hinge bolts 78,78' which form the second joint position 2 and are arranged correspondingly with respect to one another are connected with the seat plate 14 through the pillow blocks 12' provided on the sections 47 and 47' of the supporting frame 45. As is shown schematically in FIG. 1 and FIG. 3 a transversal bar 13 for the bearing and fastening of armrests (not shown) can be arranged on the supporting frame 45. The actuating mechanism 60 is arranged on the carrier body 20 in the zone of the head element 25, which mechanism can be used to actuate the gas compression spring 16 which is arranged in the upright standard 15 (FIG. 1). The actuating mechanism 60 is held in a respectively arranged recess in the head element 25 of the carrier body 20 and shall be explained below by reference to FIG. 4.

Figure 4:
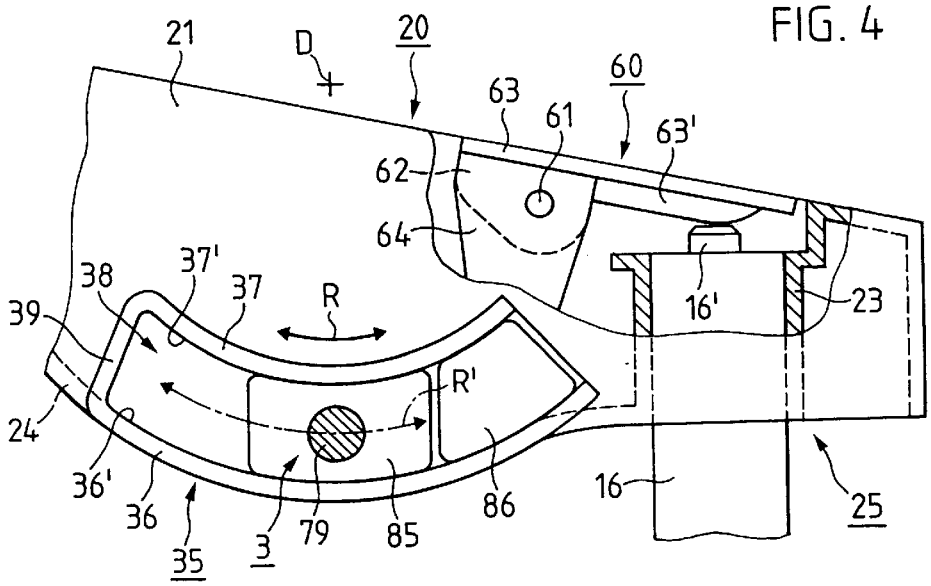
FIG. 4 shows a link guide means for the swivelling movement of the office chair pursuant to FIG. 1 which is represented as a first embodiment and is arranged on a carrier body.

FIG. 4 shows a sectional view on an enlarged scale according to the line IV—IV in FIG. 3 with the one link guide means 35 which is arranged on the one side wall 21 of the extension-arm-like carrier body 20 as well as a section of the actuating mechanism 60. The link guide means 35 comprises two guide frames 36 and 37 which are arranged at a parallel distance and are substantially arc-shaped. In the shown embodiment, the guide frames 36,37 are mutually connected by a first limit stop 39 at the end facing the swivel axis X—X (FIG. 3). In the curve path 38 formed by the two distanced guide frames 36,37 the sliding block 85 is arranged which is held on the axial body 79 of the backrest carrier 75 (FIG. 3). In a variant which is not explained in closer detail there is the possibility that a link-block guide 85,85' is each formed on the carrier arms 77,77' of the backrest carrier 75, with the individual link-block guide 85,85' in the assembled condition being in engagement with the associated link guide means 35,35'. The swivelling movement of the link-block guides 85,85' which is oriented along the arc-shaped curve path in the direction of the double arrow R occurs about an imaginary central point D along a theoretical central line R' (FIG. 4).

The link guide means 35 and 35' is arranged in such a way and is disposed on the carrier arms 77,77' of the backrest carrier 75 in such a way that it forms the arc-shaped curve path 38. The imaginary central point D, which is drawn in FIG. 4, for the arc-shaped curve path 38 of the link guide means 35,35' is arranged in this embodiment above the carrier body 20. Preferably, the imaginary central point D is arranged in such a way that it lies in the working position of the chair 100 between the surface 9 of the carrier body 20 and the facing lower side 9' of the seat carrier 45 which is oriented substantially horizontally (FIG. 1).

In the swivelling movement of the backrest carrier 75 which is oriented in the direction of the double arrow R the two link-block guides 85 and 85', which are held on the two hinge bolts 79 and 79' of the carrier arms 77 and 77', slide along the inner sliding surfaces 36' and 37' of the two guide frames 36 and 37. The link guide means 35' which is arranged on the opposite side wall 21' of the carrier body 20 and is not explained in closer detail is arranged analogously to the link guide means 35 as explained above. In the two link guide means 35,35' it is possible to provide a stop 86 which limits the swivelling movement oriented in the direction of the double arrow R. The stop 86 can be arranged at will in the respective link guide means 35,35' depending on the desired swivelling movement and can be fastened with means which are not shown. In the mentioned swivelling movement of the backrest carrier 75 the link-block guide 85,85' is swivelled, starting from basic position pursuant to FIG. 4, within the magnitude of between 20 mm to 50 mm in the link guide means 35,35'. In the swivelling movement of the backrest 90 with an angle α of 24° as represented in FIG. 2, the link-block guide 85,85' is swivelled, starting from the basic position, in an advantageous manner only with a relatively low swivelling path approx. in the magnitude of between 20 mm to 30 mm.

The actuating mechanism 60 which is partly shown in FIG. 4 comprises a release lever 63 which is provided with a thrust member 63' and is held on the carrier body 20 by means of two distanced brackets 62 and 64 and an axial bolt 61. The bracket 64 is operatively connected with a second pulling and thrust member 6, which is shown schematically in FIG. 5, in such a way that in a pulling movement pursuant to the direction of arrow 8' (FIG. 5) the release lever 63 is swivelled from the displayed position and the thrust member 63' is brought into engagement with the tappet 16' of the gas compression spring 16 and is brought out of engagement during a pushing movement pursuant to the direction of arrow 8.

Figure 5:
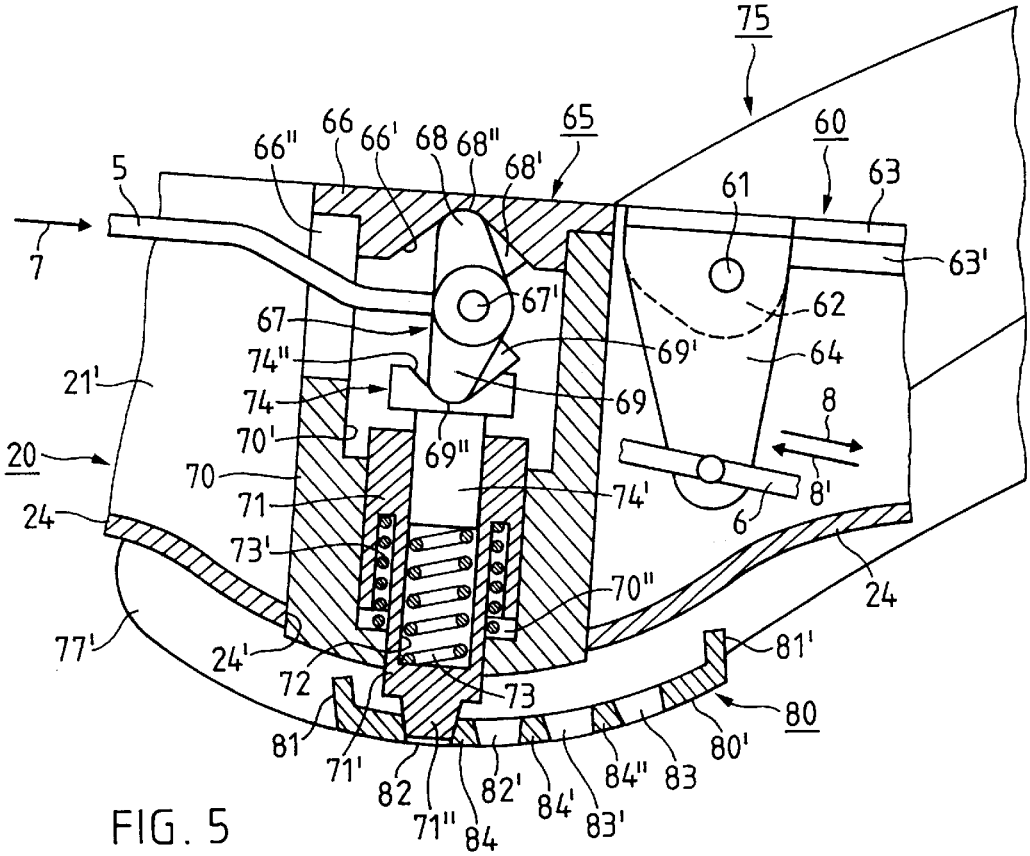
FIG. 5 shows a snap-in locking mechanism for the office chair pursuant to FIG. 1 in the fixed position which is represented as a first embodiment.

FIG. 5 shows on an enlarged scale the snap-in locking mechanism 65 in a sectional view, which mechanism is arranged on the one side wall 21' of the carrier body 20 and is attached with means not shown in closer detail. Moreover, one can recognize a section of the actuating mechanism 60 for the gas compression spring 16 which is arranged in the upright standard 15 (FIG. 1), which mechanism is arranged on the carrier body 20 and is operatively connected with the partly shown second pulling and thrust member 6, as well as a section of the backrest carrier 75 with the second transition element 80 which is arranged as a snap-in element. The second transition element 80 is arranged in a manner not shown in closer detail between the two carrier arms 77 and 77' (FIG. 3) of the backrest carrier 75, which are arranged at a parallel distance from one another, and is fastened with means (not shown).

Figure 6:
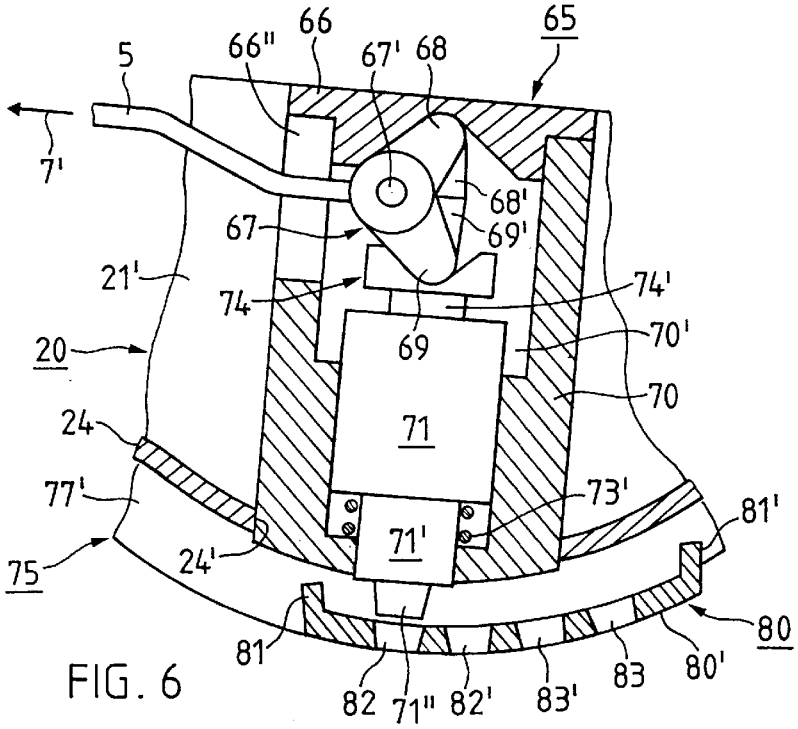
FIG. 6 shows the snap-in locking mechanism pursuant to FIG. 5 in a free-running position.
Figure 7:
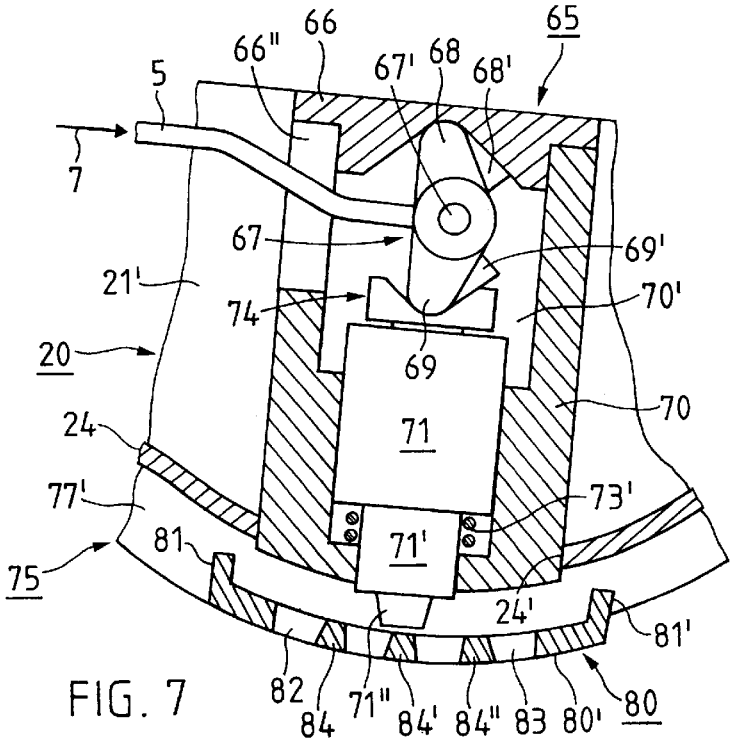
FIG. 7 shows the snap-in locking mechanism pursuant to FIG. 5 represented in a preselection position.

The transition element 80 shown in the FIGS. 5 to 7 in a profile cross section is provided at the two ends, which are arranged at a mutual distance in the swivelling direction, with a bridge 81 and 81'. Several recesses 82,82' and 83,83' are arranged between the two bridges 81 and 81' in the floor 80', which recesses are arranged in distances from one another in the direction of movement of the backrest carrier 75. Respective bridges 84,84' and 84" are arranged between the preferably conically tapering recesses 82,82' and 83,83'.

The snap-in locking mechanism which pursuant to FIG. 5 is in engagement with the transition element 80 of the backrest carrier 75 and is designated in its entirety with reference numeral 65 substantially comprises a casing 70 which is provided with a lateral recess 66", a lid 66 which is arranged thereon and is attached with means (not shown), a snap-in bracket 67 which is held in the casing 70, a thrust member 74 which is operatively connected thereto and a snap-in head 71. The individual functional elements of the snap-in locking mechanism 65 will be explained below in greater detail.

The casing 70 is provided with a first recess 70' and a second recess 70" which is connected to the same. The snap-in bracket 67 and the thrust member 74 are arranged in the first recess 70', with the snap-in head 71 which is operatively connected with the thrust member 74 being arranged in the second recess 70". The snap-in bracket 67 which is held in the casing 70 on a bolt 67' in a manner not explained in closer detail comprises a first bracket element 68 provided with a cam 68' and a second bracket element 69 provided with a cam 69'. The first bracket element 68 provided with an approximately arc-shaped facing edge 68" is arranged in a recess 66' provided on the inner side of the lid 66. The recess 66' has a contact which is arranged in a manner so as to correspond to the facing edge 68" as well as two conically expanded side areas which are not designated. The second bracket element 69 which is also provided with an arc-shaped facing edge 69" is arranged in a recess 74" of the thrust member 74, with the recess 74" being arranged approximately analogous to the recess 66' as arranged in the lid 66. The thrust member 74 is arranged with an attached guide element 74' coaxially in a blind bore 72 of the snap-in head 71 and is operatively connected with a first compression spring 73 which is arranged in the recess 72.

The snap-in head 71 is guided with an offset guide element 71' in a recess, which is not designated, of the casing 70 and is provided with a snap-in pin 71" which is attached thereto and is provided with a conically expanding arrangement. The snap-in head 71 is displaced in the axial direction depending on the actuated snap-in bracket 67 against the restoring force of the of the first compression spring 73 which is arranged in the blind bore 72 as well as against the restoring force of a second compression spring 73' which is arranged on the guide element 71' and is supported in the second recess 70" of the casing 70 in such a way that the snap-in pin 71" snaps into one of the recesses 82,82' or 83,83' provided at a distance from one another in the transition element 80.

In FIG. 5 the snap-in bracket 67 of the snap-in mechanism 65 which is explained above in closer detail is swivelled about the bolt 67' by means by a first pulling and thrust member 5, which is operatively connected with the snap-in bracket 67 and is shown schematically and is guided through the recess 66", through a thrusting movement oriented in the direction of arrow 7 in such a way that the snap-in head 71 is displaced against the restoring force of the two compression springs 73,73' in the axial direction and snaps with the attached snap-in pin 71" into the recess 82 of the transition element 80, for example. In this position the relative movement of the backrest carrier 75 is blocked with respect to the carrier body 20.

In FIG. 6 the snap-in bracket 67 is swivelled about the bolt 67' by means of the pulling and thrust member 5 by a pulling movement oriented in the direction of arrow 7', so that the snap-in head 71 is displaced in the axial direction by the restoring force of the two compression springs 73,73' in such a way that the snap-in pin 71" comes out of engagement with the transition element 80. In this position the backrest carrier 75 can be swivelled in a free-running manner relative to the carrier body 20.

In FIG. 7 the snap-in bracket 67 is swivelled about the bolt 67' by means of the pulling and thrust member 5 by the pushing movement oriented in the direction of arrow 7, so that the snap-in pin 71" can snap into one of the recesses 82,82' or 83,83' or, as is shown in FIG. 7, rests spring-loaded on one of the bridges 84, 84' or 84" provided between the recesses 82,82' or 83,83' in a so-called preselection position until the snap-in pin 71", during a swivelling movement of the backrest carrier 75, snaps into one of the recesses 82,82' or 83,83' by the restoring force of the compression springs 73,73' and depending on the position.

Notice shall be taken at this juncture that in a further embodiment, which is not shown herein, it is possible to provide toothed wheel work (not shown) on the inner side (not designated) of the transition element 80 which is arranged between the two carrier arms 77 and 77' of the backrest carrier 75 and that the snap-in pin 71" can be provided analogously with a toothed wheel work on the facing face side. In this way it is substantially achieved that the backrest carrier 75 is adjustable in several, snap-in positions relative to the carrier body 20 during the swivelling movement.

FIG. 8 shows the forward joint position 1 (FIG. 1,2) on an enlarged scale and in a sectional view and one can recognize the swivel body 40 with the deformed tube element 41', which body is arranged and held on the knee-side on the carrier body 20, as well as the torsional element 46 which is arranged therein and penetrates the receiving tube 40 in the axial direction. In the represented embodiment the torsional element 46 comprises two superimposed torsional rods 46',46" which are arranged rectangularly in the profile cross section. The two torsional rods 46',46" are preferably arranged in the represented embodiment with longitudinal sides resting mutually on one another approximately horizontal in the swivel body 40. A tensioning element 50 is attached to the receiving tube 41 of the swivel body 40 which is in operative connection with the tensioning mechanism 55 which is arranged on the supporting bearing 30 of the carrier body 20. The tensioning element 50 which is arranged on and fastened to the receiving tube 41 of the swivel body 40 will be explained below in connection with FIG. 9.

FIG. 8 further shows the supporting bearing 30 which is shown in a profile cross section and is arranged for receiving and bearing the tensioning mechanism 55. The. supporting bearing 30 comprises an attached abutting wall 31 which is attached to the face wall 26, a floor element 32 which is attached thereto and to the floor 24 of the carrier body 20 and a transition element 32' which is arranged at a parallel distance therefrom. A bridge 33 which is provided with a recess 33' is attached to the floor element 32.

The tensioning mechanism 55 which is arranged in the supporting bearing 30 which is arranged approximately in the shape of a casing comprises a hub element 56 (not represented in closer detail) with rolls 57 and 57' which are laterally held thereon. The hub element 57 is penetrated by a setscrew 59 which rests with a bearing element 29 on the inner side 31' of the abutting wall 31 and which is held with the other end (not designated in closer detail) in the recess 33' of the bridge 33. The setscrew 59 is operatively connected with the adjusting wheel 58 in such a way that as a result of the rotational movement oriented in the direction of arrow Y' about the axis 59' the hub element 56 with the two rollers 57,57' which are laterally held thereon is displaced either in the direction of the arrow Z' or Z". As a result of the movement oriented in the direction of arrow Z', the two rollers 57 and 57' are pressed against a plate 51 of the tensioning element 50 which is provided with a longitudinal recess 51' and thereby the spring-elastic restoring force of the torsional element 46 which is arranged in the swivel body 40 is pretensioned. During the movement oriented in the direction of arrow Z" the spring-elastic restoring force of the torsional element 46 can be reduced or relaxed again.

FIG. 9 shows a section of swivel body 40 which is shown in a top view and on an enlarged scale and which substantially forms the forward swivel axis X—X. The swivel body 40 comprises the receiving tube 41 which in the zone of the partially represented axis of symmetry S—S of the chair 100 (FIG. 3) is provided on the outer contour of the two torsional rods 46' and 46" with the shape-adapted tube element 41' (FIG. 8).

A bridge 52 and 53 of the tensioning element 50 is arranged on either side of the deformed tube element 41'. The two bridges 52,53 each grasp over the receiving tube 41 with an approximately semi-circular section 52' and 53' which is adjusted to the outer diameter of the receiving tube 41 and are attached thereon in a manner not shown. The plate 51 is arranged between the two bridges 52 and 53, which plate is provided with a longitudinal recess 51' for the setscrew 59 and is attached to the bridges 52,53 and to the receiving tube 41. Moreover, FIG. 9 shows a clamping sleeve 42 which is arranged at the one end of the receiving tube 41 and comprises the section 49 of the seat carrier 45 which is arranged and attached thereon (FIG. 3). The clamping sleeve 42 is provided at the outer end with a section 42' whose shape is adjusted to the outer contour of the two torsional rods 46' and 46". The other opposite end of the receiving tube 41 is arranged in an analogous manner and is provided with a clamping sleeve 43 which is provided at the outer end with a shape-adapted section 43' (FIG. 3).

Figure 10:
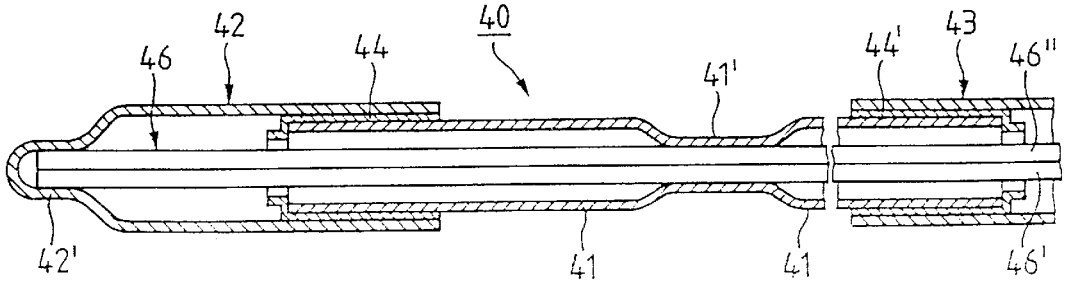
FIG. 10 shows the section of the horizontal swivel axis represented in a sectional view along the line A—A in FIG. 9.

FIG. 10 shows the swivel body 40 pursuant to the line A—A in FIG. 9 in a sectional view and one can recognize the tube element 41' whose shape is adapted to the two torsional rods 46' and 46" as well as the receiving tube 41 arranged in the one clamping sleeve 42. A slide bush 44 and 44' is preferably arranged at the two ends of the receiving tube 41, on which bushes the clamping tubes 42 and 43 are held which are operatively connected with the seat carrier 45.

The seat carrier 45 which is attached to the two clamping sleeves 42,43 of the swivel body 40 as well as the backrest carrier 75 which is articulated by way of the second joint position 2 to the seat carrier 45 and by way of the third joint position 3 to the carrier arm 20 in the shape of extension arm can be swivelled about the horizontal swivel axis X—X of the first joint position 1 against the adjustable spring-elastic restoring force of the torsional element 46 which is arranged in the swivel body 40 and is operatively connected in a form-fitting manner with the receiving tube 41 as well as the two clamping sleeves 42,43.

Figure 11:
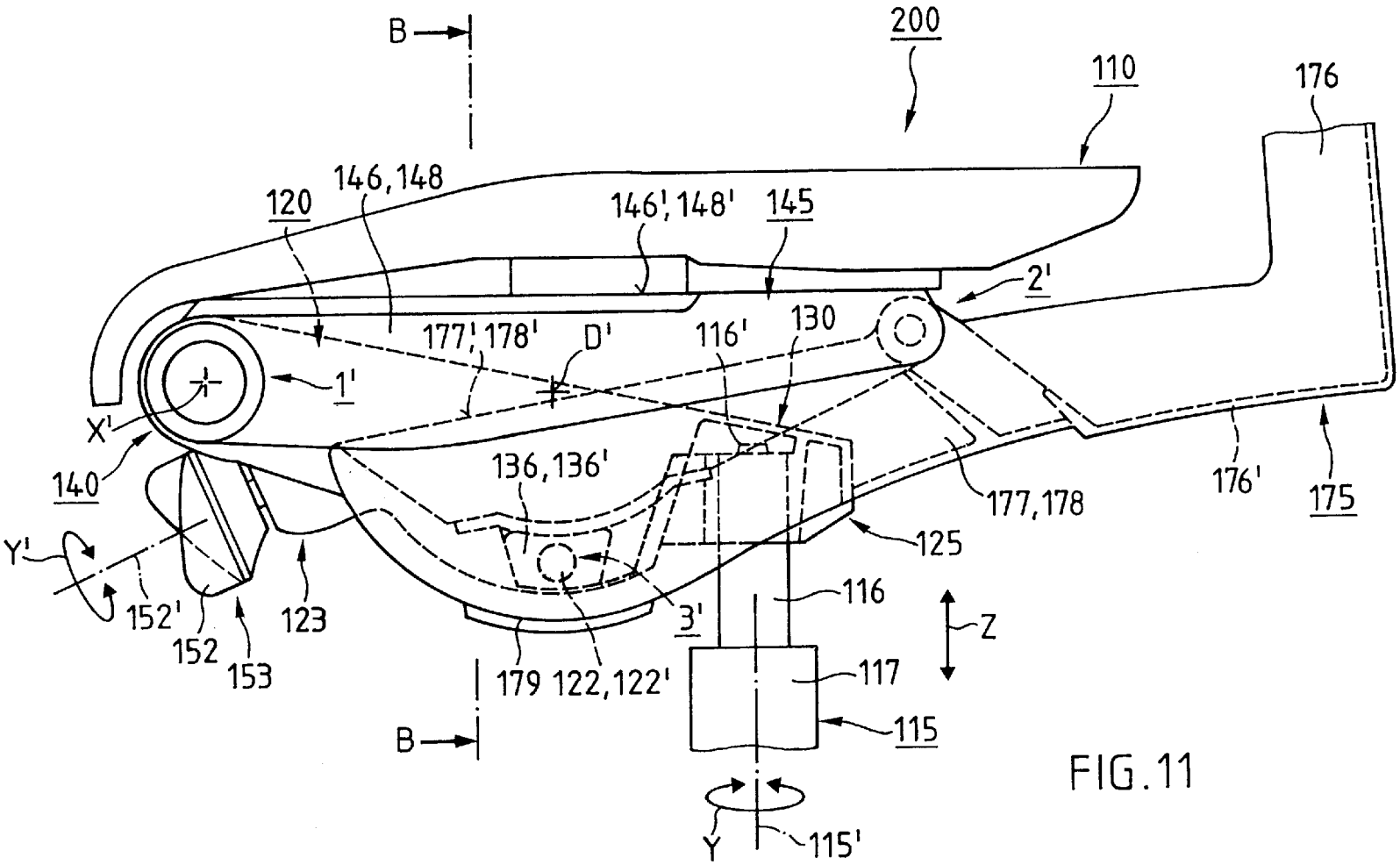
FIG. 11 shows an office chair in the sitting and working position represented as a second embodiment and in a schematic side view.

FIG. 11 shows as a second embodiment a section of an office chair 200 shown in a schematic sectional side view and one can recognize a partly represented upright standard 115, a carrier body 120 which is held thereon and is provided in the knee-sided area with a first joint position 1', a seat carrier 145 which is held thereon and is arranged for receiving a seat body 110, as well as a backrest carrier 175. The seat carrier 145 comprises two extension arms 146 and 148 which are arranged at a parallel distance from one another and are each provided on the knee-sided end with a sleeve body 147 and 149 which are arranged thereon. The carrier body 120, which is provided with a hollow cylindrical bearing element 126 (FIG. 12), is arranged between the two sleeve bodies 147 and 149. The upright standard 115 as shown partly in FIG. 11 comprises an upright stand pipe 117 as well as a gas compression spring 116 which is arranged therein and is operatively connected with an actuating mechanism 130. The elements held on the upright standard 115 of the office chair 200, as described above in connection with the office chair 100 pursuant to FIG. 1, can be both height adjusted in the direction of the double arrow Z and rotated in the direction of the double arrow Y about the vertical axis 115' of the upright standard 115 in the horizontal plane. The actuating mechanism 130 which can be brought into engagement with the tappet 116' of the gas compression spring 116 is preferably arranged analogously to the actuating mechanism 60 as described in connection with FIGS. 4 and 5.

The backrest carrier 175 comprises the two carrier arms 177 and 178 which are oriented in the direction of the knee-sided joint position 1' and are operatively connected by way of a second joint position 2' with the two extension arms 146 and 148 of the seat carrier 145 and are held by way of a third joint position 3' on the carrier body 120. A swivel device 140 which substantially forms the horizontal swivel axis X'—X' as well as a schematically shown support bearing 123 are arranged in the knee-sided zone on the carrier body 120, which bearing is arranged for receiving a tensioning mechanism 153 which is not shown in greater detail. The tensioning mechanism 153 for setting the spring-elastic restoring force of the spring elements 141,141' (FIG. 12) which are arranged in the swivel device 140 comprises a setting wheel 152, which is rotatable about an axis 152' in the direction of the double arrow Y', as well as a setscrew 151. The setscrew 151 is operatively connected with a tensioning element 150 of the swivel device 140.

Figure 12:
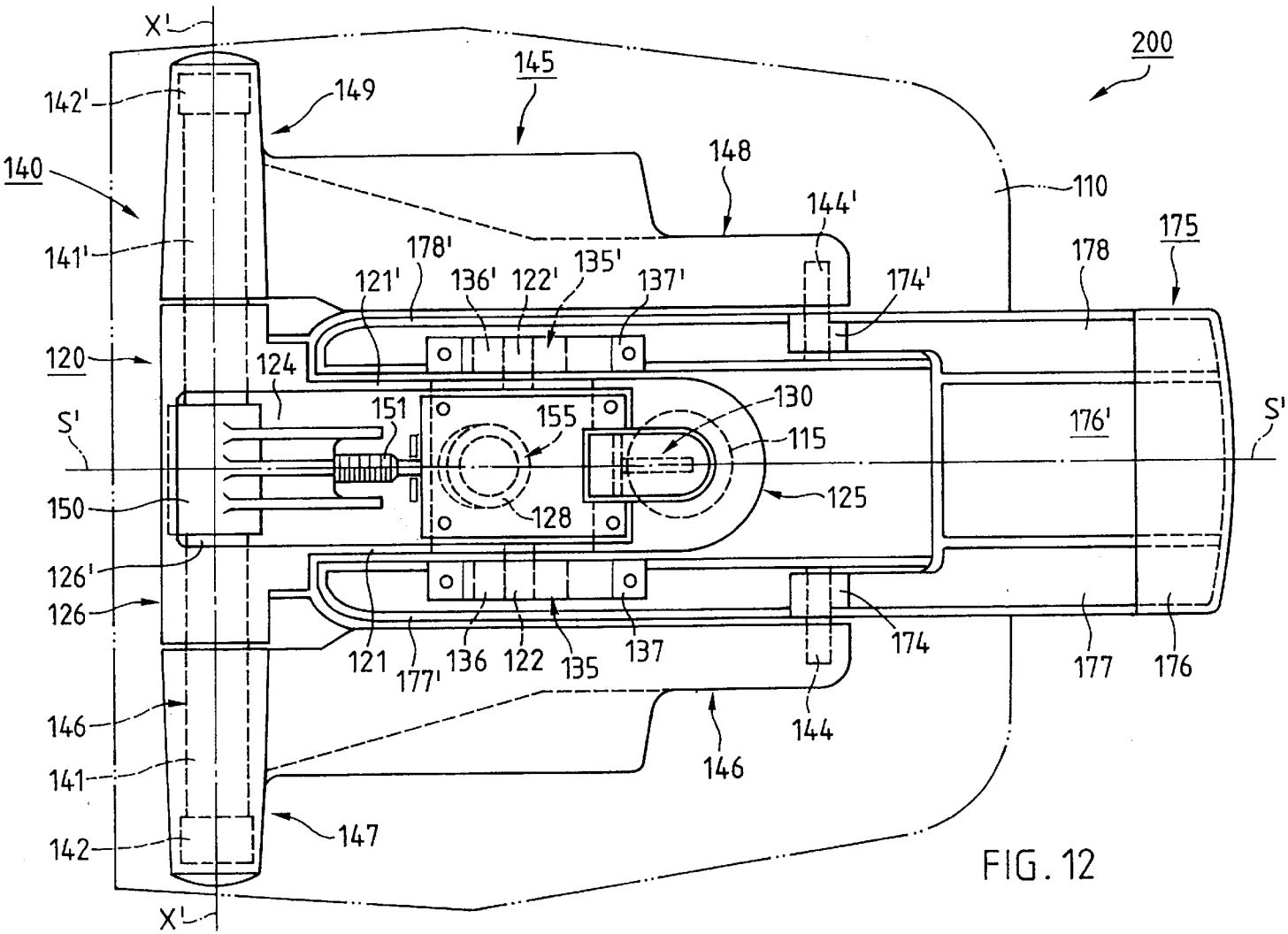
FIG. 12 shows the office chair pursuant to FIG. 11 with the relevant functional elements in a top view and on an enlarged scale.

FIG. 12 shows the office chair 200 in a top view and one can recognize the carrier body 120 which is arranged on the axis of symmetry S'—S' and held with the head element 125 on the upright standard 115 (FIG. 11). The carrier body 120 comprises two side walls 121 and 121' which are mutually connected by a floor 124 and are arranged at a distance from one another. A bearing pin 122 and 122' is arranged at either of the two side walls 121,121' and is attached in a manner not shown. A link-block guide 136,136' is held on each of the two bearing pins 122 and 122' and attached with means not shown. In the forward knee-sided zone the carrier body 120 is provided with the bearing element 126 which is oriented transversally to the axis of symmetry S'—S'.

The bearing element 126 is provided with a recess 126' in which the spanner 150 is arranged and is held in a manner not shown. The extension arms 146 and 148 of the seat carrier 145 are arranged on either side of the axis of symmetry S'—S', which arms are each provided in the knee-sided zone with sleeve bodies 147 and 149 which are attached thereto. The sleeve bodies 147 are arranged to receive torsional rods 141 and 141' which are shown schematically in FIG. 12. The torsional rods 141 and 141' are operatively connected with the one end with the spanner 150 and with the other end are each arranged with the other end in a clamping bush 142 and 142' and are secured against rotation. The clamping bushes 142 and 142' are arranged in a manner not shown in greater detail in the the two sleeve bodies 147 and 149 (FIG. 12) which are attached on the two extension arms 146,148 of the seat carrier 145. At the forward knee-sided end the two extension arms 146 and 148 are each held on the swivel axis X'—X' of the swivel device 140 by means of the sleeve bodies 147 and 149 which are arranged thereon and attached thereto. A bearing pin 144 and 144' is each arranged on the opposite other end on the two extension arms 146 and 148. The carrier arms 177 and 178 of the backrest carrier 175 which are each provided with a bearing 174 and 174' are articulated on the bearing pins 144, 144'.

Departing from the first embodiment pursuant to FIG. 1 to FIG. 4 the link guide means 135 and 135' which is oriented in the second embodiment pursuant to FIG. 11 and FIG. 12 at a parallel distance from the axis of symmetry S'—S' is arranged on the two carrier arms 177 and 178 of the backrest carrier 175. The link-block guide 136 and 136' is arranged in the arcshaped link guide means 135 and 135' on the carrier body 120 by means of the hinge pin 122,122'. In this modification the link guide means 135 and 135' is moved during the swivelling movement of the backrest carrier 175 which is oriented in the sitting direction relative to the two link-block guides 136,136' which are held on the stationary carrier body 120.

As is shown schematically in FIG. 11, the imaginary centre point D' for the arc-shaped curve path of the link guide means 135 and 135' is arranged above the upper edge 177' and 178' of the two carrier arms 177 and 178 of the backrest carrier 178 which are arranged inclined starting from the second joint position 2' in the direction of the third joint position 3'. Preferably, the imaginary centre point D' is arranged in such a way that it is arranged, in the working position of the chair 200 (FIG. 11), between the substantially horizontally oriented surface 146' and 148' of the two extension arms 146 and 148 and the upper edge 177' and 178' of the inclined carrier arms 177 and 178 of the backrest carrier 175. In the zone on the backrest side the two carrier arms 177 and 178 are mutually connected by a backrest element 176 and by a floor 176' (FIG. 12) which is attached thereto.

Figure 13:
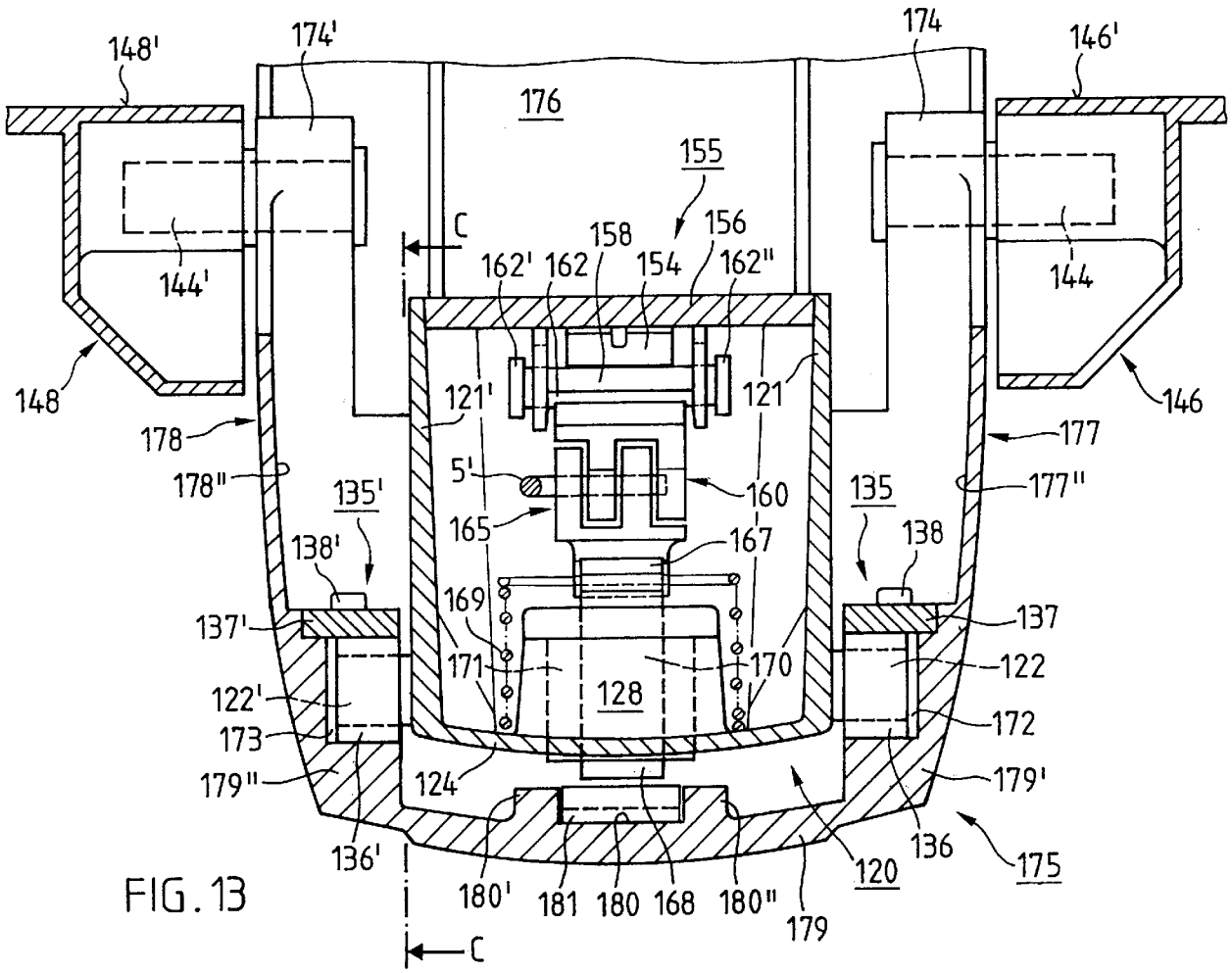
FIG. 13 shows a section of the office chair with a link guide means arranged on the backrest carrier and a snap-in locking mechanism, represented in a sectional view along the line B—B in FIG. 11.

FIG. 13 shows a sectional view pursuant to line B—B pursuant to FIG. 11 on an enlarged scale and one can recognize the backrest carrier 175 which is arranged between the two extension arms 146 and 148 of the seat carrier 145, which backrest carrier 175 is held by means of the carrier arms 177 and 178 on the bearing pins 144 and 144' of the two extension arms 146,148. In the lower zone of the two carrier arms 177,178 which are mutually connected by a floor element 179 an offset 179' is provided on the inner side 177" of the carrier arm 177 in which a recess 172, formed as an arc-shaped curve path, is arranged for the link guide means 135. An offset 179" is provided on the opposite inner side 178" of the other carrier arm 178 in which a recess 173 for the link guide means 135' is also arranged as an arc-shaped curve path. Moreover, one can recognize the link-block guides 136 and 136' which are arranged in the two recesses 172 and 173 and are held on the bearing pins 122 and 122'. The link-block guides 136 and 136' are each held by a slide plate 137 and 137' attached by screws 138,138' on the offsets 179' and 179" in the curve path of the link guide means 135 and 135'. The linkblock guides 136 and 136' are each held by a slide plate 137 and 137' in the curve path of the link guide means 135 and 135', which slide plate is attached by screws 138, 138' on the offsets 179' and 179". The two slide plates 137,137' are preferably, as is shown in FIGS. 14 and 15, arranged concavely analogous to the arc-shaped curve path.

Moreover, one can recognize in FIG. 13 a snap-in locking mechanism 155 which is arranged between the two side walls 121,121' of the carrier body 120 and which can be brought into engagement by way of a snap-in head 170 which is operatively connected thereto and comprises a snap-in segment 181 which is arranged on the floor element 179 of the backrest carrier 175. The snap-in segment 181 which is provided with a toothed wheel work (FIGS. 16*a* to 16*b*) is provided with a recess 180 provided in the floor element 179 of the backrest carrier 175 and is fixed by lateral bridges 180' and 180" on the floor element 179. The operation and the details of the snap-in mechanism 155 will be described in conjunction with FIGS. 16*a* to 16*c*.

Figure 14:
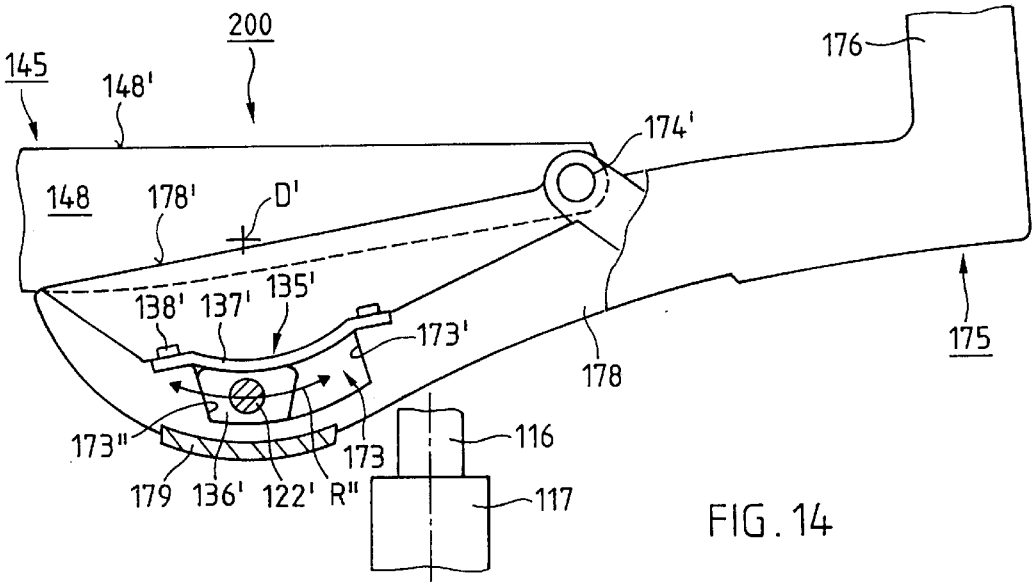
FIG. 14 shows a section of the office chair pursuant to FIG. 11 in the working position with the link guide means being arranged on the backrest carrier for the swivelling movement, represented in a sectional view along the line C—C in FIG. 13.

FIG. 14 shows a sectional view pursuant to the line C—C in FIG. 13 and one can recognize a section of the office chair 200 pursuant to FIG. 11 in the working position with the extension arm 148 of the seat carrier 145 articulated on the bearing 174' of the carrier arm 178 as well as the link guide means 135' which is arranged on the one carrier arm 178 of the backrest carrier 175. The arc-shaped recess 173 for the link guide means 135' is limited by the two opposite side walls 173' and 173". The link-block guide 136' arranged on the one bearing pin 122' is held in the recess 173, which guide is secured by the concavely arranged slide plate 137' and the screws 138'. In the working position as shown in FIG. 14 the swivelling movement of the carrier arm 178 is limited by a side wall 173" of the recess 173. Moreover, one can recognize the theoretical centre point D' which is arranged above the upper edge 178' of the carrier arm 178 for the arc-shaped recess 173 of the link guide means 135'. The floor element 179 of the backrest carrier 175 is arranged below the link guide means 135'.

Figure 15:
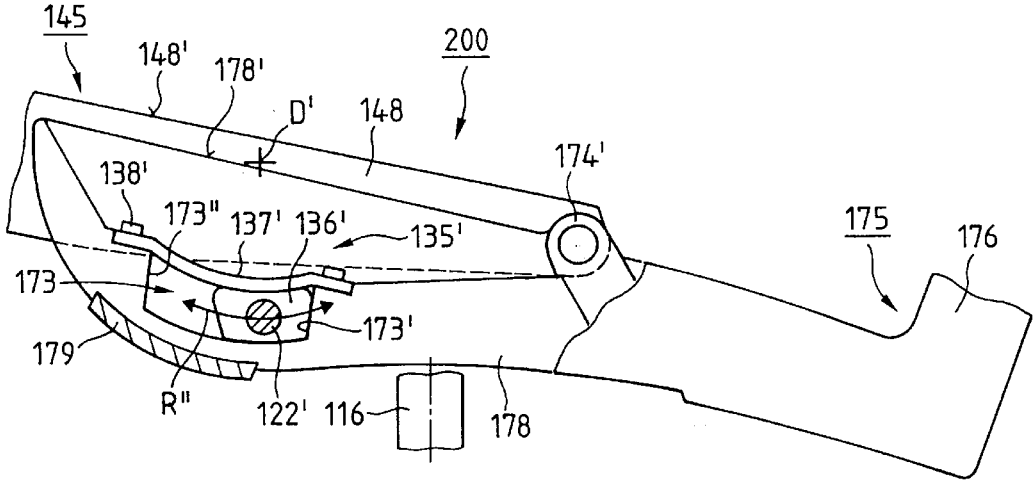
FIG. 15 shows the section pursuant to FIG. 14 swivelled into an reclined position about a knee-sided horizontal swivel axis.

FIG. 15 shows the section of the office chair 200 in the rearwardly inclined position and one can recognize the inclined extension arm 148 and the carrier arm 178 of the backrest carrier 175 which is swivelled about the bearing 174' relative to the fixed link-block guide 136'. In the inclined position as shown in FIG. 15 (relax position) the swivelling movement of the carrier arm 178 is limited by the other side wall 173' of the recess 173.

Notice shall be taken here that the link guide means 135 arranged on the opposite carrier arm 177 of the backrest carrier 175 is arranged in an analogous manner to the link guide means 135' as described above in connection with the FIGS. 14 and 15. The sequence of movement of the backrest carrier 175, which is oriented relative to the carrier body 120 arranged on the fixed upright standard 115, with the extension arms 146 and 148 of the seat carrier 145 which are articulated thereon occurs absolutely synchronously. Moreover, one can recognize in FIGS. 14 and 15 the imaginary centre point D' for the theoretical centre line R" of the curve path, which centre point is arranged above the upper edge 178' of the carrier arm 178.

Figure 16C:
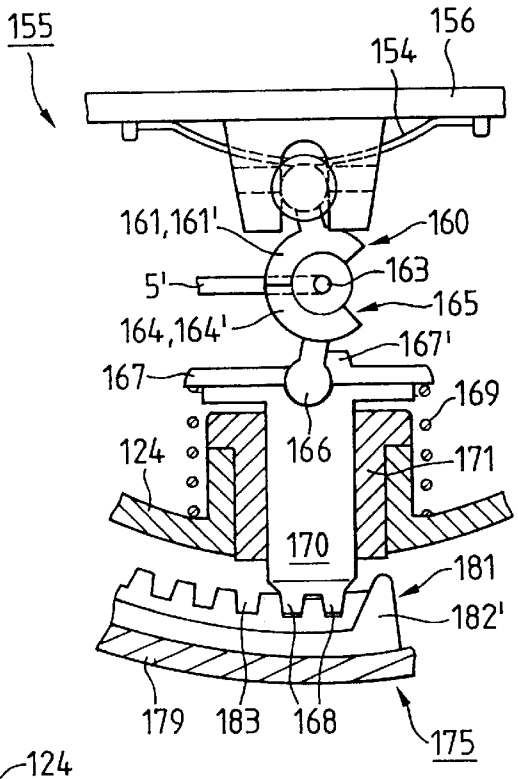
FIG. 16*c* shows the snap-in locking mechanism, represented in the locked position, for the office chair pursuant to FIG. 11 in the reclined position.
Figure 16B:
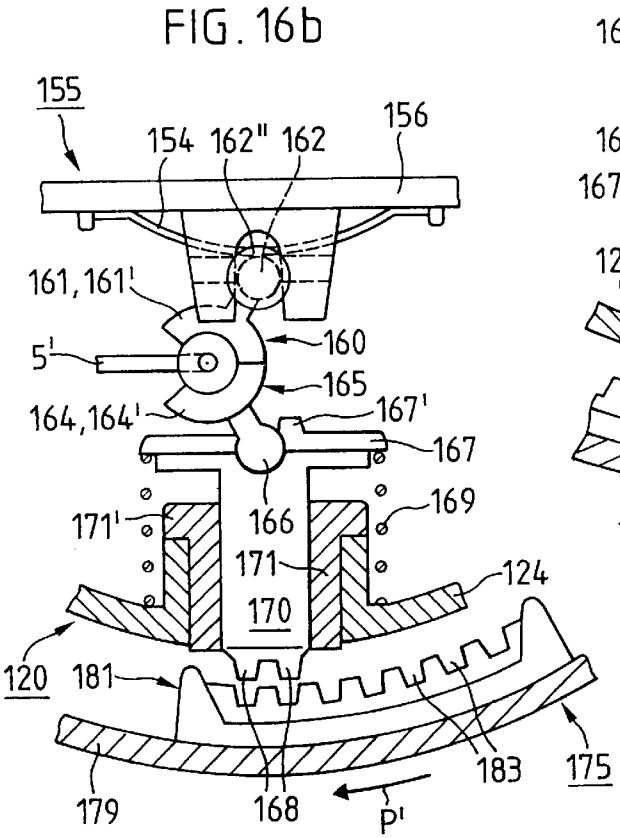
FIG. 16*b* shows the snap-in locking mechanism pursuant to FIG. 16*a* represented in the free-running position.
Figure 16A:
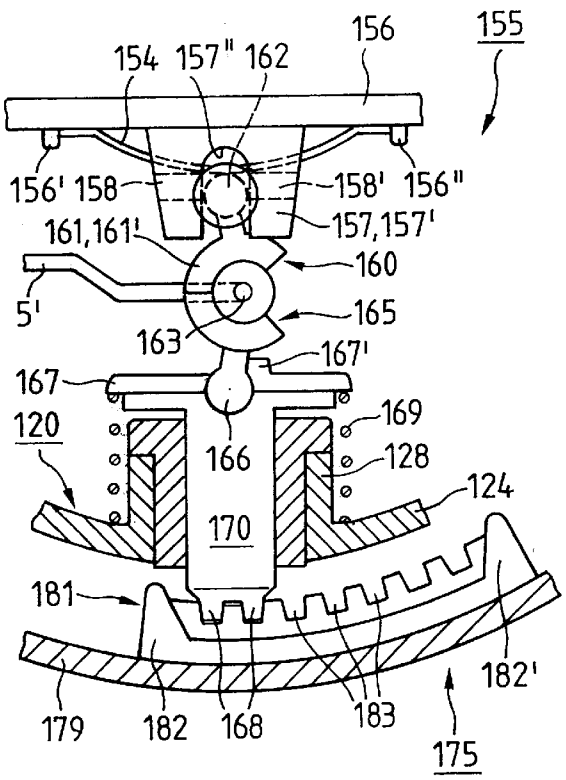
FIG. 16*a* shows the snap-in locking mechanism partly shown in a sectional view for the office chair pursuant to FIG. 11 in the position locked in the sitting and working position.

FIGS. 16*a* to 16*c* show the snap-in mechanism 155 in different positions depending on the desired position of the backrest carrier 175, which mechanism can be brought into engagement with the same and is arranged on the fixed carrier body 120. In FIG. 16*a* the backrest carrier 175 is blocked in the sitting and working position with respect to the carrier body 120 and in FIG. 16*b* in a so-called free-running position and in FIG. 16*c* in the backwardly inclined and blocked position (relax position).

The snap-in segment 181 arranged on the forward floor element 179 of the backrest carrier 175 is provided with a toothed wheel work 183 arranged between two end elements 182 and 182', which toothed wheel work, starting out from the blocked position pursuant to FIG. 16*a*, can be blocked in further intermediate positions during the swivelling movement of the backrest carrier 175 oriented in the direction of arrow P' pursuant to FIG. 16*b* up to the blocked position pursuant to FIG. 16*c*. In the represented embodiment of the snap-in segment 181 the backrest carrier 175 which can be swivelled relative to the carrier body 120 can be blocked in a total of six positions. The snap-in segment 181 can also be arranged with a larger or smaller number of teeth of the toothed wheel work 183 oriented in the swivelling direction.

The snap-in mechanism 155 shown in FIGS. 16*a* to 16*c* in a side and partly sectional view comprises a bearing plate 156, a first snap-in lever 160 which is swivellably held thereon, a second snap-in lever 165 which is connected to the same in an articulated manner, as well as a snap-in head 170 which is arranged in a guide bush 171. The guide bush 171 which is provided with a flange 171' is arranged in a connecting piece 128 which is provided on the floor 124 and is attached thereto for example. The two snap-in levers 160 and 165 are mutually operatively connected by way of a pulling and thrust member 5'. On the bearing plate 156 there are disposed two cams 156' and 156" which are arranged at a distance from one another and two flanges 157 and 157' which are arranged at a distance from one another and are each provided with a recess 157".

A concavely arranged leaf spring 154 is arranged between the two flanges 157 and 157, which spring rests with its two ends on the cams 156' and 156" on the bearing plate 156 as well as with the lower side (not designated) on two rods 158 and 158 which are arranged between the flanges 157 and 157' and are provided as an abutment. The first snap-in lever 160 comprises a cylindrical axial body 162 which is provided at each of the two ends with a disc 162' and 162". The first snap-in lever 160 is held with the axial body 162 in the recess 157" of the two flanges 157,157'. Two first brackets 161,161' which are distanced from one another are arranged on the axial body 162. They are operatively connected with second brackets 164,164' of the second snap-in lever 165 which are disposed in between by way of a bearing journal 163.

The second snap-in lever 165 is held in a bearing plate 167 of the snap-in head 170 by way of a cyclindrical axial body 166 arranged on the second lever. A pulling and thrust member 5' is arranged on the bearing journal 163 mutually connecting the two snap-in levers 160 and 165, by means of which the two snap-in levers 160 and 165 are swivellable depending on the direction of movement of the pulling and thrust member 5'.

The snap-in head 170 is provided with the bearing plate 167 on the side facing the second snap-in lever 165, which plate is provided with a stop 167' as well as a recess (not designated) which is accordingly arranged for bearing the cylindrical axial body 166. At the other end of the snap-in head 170 two snap-in pins 168 are arranged at a distance from one another for example which can be brought into and out of engagement with the toothed wheel work 183 of the snap-in segment 181. The snap-in head 170 which is arranged in the guide bush 171 is pressed with a compression spring 169 against second snap-in lever 165, which compression spring rests with the one end on the bearing plate 167 of the snapin head 170 and with the other end on the floor 124 of the carrier body 120.

Based on the blocked sitting and working position as shown in FIG. 16*a*, the two can be pivoted about the bearing journal 163 into the so-called free-running position (FIG. 16*b*) by means of a tractive force acting on the pulling and thrust member 5', in which position the snap-in head 170 comes out of engagement with the toothed wheel work 183 of the snap-in element 181 (FIG. 16*b*) by the effect of the compression spring 169 with the snap-in pins 168 which are arranged thereon. Thereafter the two snap-in levers 160 and 165 are swivelled by the pulling and thrust member 5' into a preselection position (not shown in greater detail) in which the snap-in pins 168 are arranged above the toothed wheel work. In the desired intermediate position or in the completely rearwardly inclined position (relax position) the snap-in pins 168 are again brought into engagement with the toothed wheel work 183 of the snap in-element 181 by the restoring force of the leaf spring 154 (FIG. 16*c*).

We claim:

1. A chair that is adjustable between at least an upright position and a reclined position, said chair comprising:

a carrier body having an upper surface and a lower surface, said carrier body supported by an upright standard and further having a knee-side and a backrest side;

a first joint position located on said knee-side of said carrier body, said first joint position comprising a swivel axis oriented transversely to a sitting direction, said sitting direction extending between said knee-side and said backrest side, said swivel axis including a spring element;

a seat carrier having a knee-side and a backrest side, and further having an upper surface and a lower surface, said seat carrier being swivelly positionable about said first joint position and against a biasing force of said spring element;

a backrest carrier operatively connected to said seat carrier at a second joint position, said backrest carrier further being operatively connected to said carrier body at a third joint position, said third joint position providing bidirectional swiveling movement of said backrest carrier in the sitting direction, said backrest carrier being swivelly adjustable relative to said carrier body by at least one link guide, said at least one link guide comprising a generally arc-shaped path member, said at least one link guide being located intermediate said first joint position and said upright standard, said at least one link guide extending in the direction of the swivelling movement of said backrest carrier, and said backrest carrier being selectively and removably engagable in one of a plurality of positions along said generally arc-shaped path member by a snap-in mechanism, said snap-in mechanism mounted on said carrier body and removably engagable with said backrest carrier.

2. The chair according to claim 1, said at least one link guide being located on said carrier body, and said backrest carrier being swivellable in the sitting direction relative to said carrier body by at least one link block guide, said at least one link block guide mounted to said backrest carrier and engaging said at least one link guide.

3. The chair according to claim 2, said generally arc-shaped path member having an arc defining a central axis, said central axis being positioned intermediate said upper surface of said carrier body and said lower surface of said seat carrier when the chair is in the upright position, said carrier body being in an inclined position and said seat carrier being in a generally horizontal position, when the chair is in the upright position.

4. The chair according to claim 1, said at least one link guide being mounted to said backrest carrier, said backrest carrier being swivellable in the sitting direction relative to said carrier body by at least one link block guide, said at least one link block guide mounted to said carrier body and engaging said at least one link guide.

5. The chair according to claim 4, said generally arc-shaped path member having an arc defining a central axis, said central axis being positioned above said backrest carrier when the chair is in the upright position, said backrest carrier being inclined intermediate said second joint position and said third joint position, when the chair is in the upright position.

6. The chair according to claim 5, said backrest carrier having a carrier arm having an upper surface and a lower surface, and when the chair is in the upright position, said central axis is positioned intermediate said upper surface of said seat carrier and said upper surface of carrier arm, said seat carrier being in a substantially horizontal position when said chair is in said upright position.

7. The chair according to claim 1, said backrest carrier being guided for swivelling movement with respect to said carrier body, in said at least one link guide by at least one link-block guide, said at least one link block guide mounted on a hinge pin.

8. The chair according to claim 1, said backrest carrier being guided for swivelling movement with respect to said carrier body, in said at least one link guide by a hinge pin.

9. The chair according to claim 1, said first joint position further comprising a swivel body pivotally mounted to said knee-side of said carrier body, said swivel body forming said swivel axis and comprising a tensioning element operatively connected to a tensioning mechanism, said spring element comprising a torsional element positioned within said swivel body, and the biasing force of said torsional element being adjustable by said tensioning mechanism.

10. The chair according to claim 9, said knee-side of said seat carrier being operatively connected to said swivel body, and said backrest side of said seat carrier being connected to said backrest carrier at said second joint position, said seat carrier being swivellable with respect to said carrier body about said swivel axis against said adjustable biasing force of said torsional element.

11. The chair according to claim 9, said torsional element comprising at least two torsional rods superimposed with each other and having a rectangular cross-section, said rods being operatively connected to said tensioning mechanism.

12. The chair according to claim 9, said tensioning mechanism comprising a setscrew mounted to a supporting bearing provided on said carrier body, said setscrew providing for the adjustment of the biasing force of said torsional element.

13. The chair according to claim 1, said backrest carrier comprising a connecting element having an inner side and an outer side, said inner side being proximate to said lower surface of said carrier body, and said snap-in mechanism being adapted to selectively block the swivelling movement of said backrest carrier.

14. The chair according to claim 13, said connecting element further comprising a recess adapted to removably receive a compression spring-loaded snap-in pin.

15. The chair according to claim 13, said inner side of connecting element comprising a snap-in segment having a plurality of spaced recesses, said snap-in mechanism comprising a snap-in pin removably and selectively engagable with a recess of said plurality of recesses.

16. The chair according to claim 13, further comprising:

a thrust member mounted to said snap-in mechanism and operatively connected to a snap-in bracket, said snap-in bracket comprising two parts, each part being swivellable about a common axis, said thrust member being displaceable in a predetermined direction against a biasing force of a compression spring; and a snap-in pin mounted to said snap-in mechanism, said thrust member being adapted to removably engage said snap-in pin with a recess provided in said inner side of said connecting element, said recess adapted to receive said snap-in pin.

17. A chair that is adjustable between at least an upright position and a reclined position, said chair comprising:

a carrier body having an upper surface and a lower surface, said carrier body supported by an upright standard and further having a knee-side and a backrest side;

a first joint located on said knee-side of said carrier body, said first joint comprising a pivot member oriented transversely to a sitting direction, the sitting direction extending between said knee-side and said backrest side, said pivot member having a torsional element disposed therein and further having a tensioning element, said tensioning element operatively connected to a tensioning mechanism, and a biasing force of said torsional element being adjustable by said tensioning mechanism;

a seat carrier having a knee-side and a backrest side, and further having an upper surface and a lower surface, said seat carrier being swivelly positionable about said first pivot member and against said biasing force of said torsional element, said knee-side of said seat carrier being operatively connected to said pivot member;

a backrest carrier operatively connected to said backrest side of said seat carrier at a second joint, said backrest carrier further being operatively connected to said carrier body at a third joint;

at least one link guide located at said third joint and providing pivoting adjustment of said backrest carrier relative to said carrier body in the sitting direction, said at least one link guide comprising a generally arc-shaped path defining member, said at least one link guide located on one of said carrier body and said backrest carrier, said at least one link guide being located intermediate said first joint and said upright standard, said at least one link guide extending in the direction of the swivelling movement of said backrest carrier, and said backrest carrier being selectively and removably engagable in one of a plurality of positions along said generally arc-shaped path defining member by a snap-in mechanism, said snap-in mechanism mounted on said carrier body and removably engagable with said backrest carrier;

at least one link block guide mounted to the other of said carrier body and said backrest carrier, said at least one link block guide engaging said at least one link guide; and a connecting element mounted to said backrest carrier and having an inner side and an outer side, said inner side being proximate to said lower surface of said carrier body, and said snap-in mechanism being adapted to selectively block the swivelling movement of said backrest carrier.

18. The chair according to claim 17, further comprising:

a thrust member mounted to said snap-in mechanism and operatively connected to a snap-in bracket, said snap-in bracket comprising two parts, each part being swivellable about a common axis, said thrust member being displaceable in a predetermined direction against a biasing force of at least one compression spring; and a snap-in pin mounted to said snap-in mechanism, said thrust member being adapted to removably engage said snap-in pin with a recess provided in said inner side of said connecting element, said recess adapted to receive said snap-in pin.

* * * * *